US007329195B2

(12) United States Patent
Pearson

(10) Patent No.: US 7,329,195 B2
(45) **Date of Patent: *Feb. 12, 2008**

(54) DURABLE HIGH PERFORMANCE HOCKEY STICK

(75) Inventor: Robert T. Pearson, Banning, CA (US)

(73) Assignee: Mission Itech Hockey, Inc., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/357,241

(22) Filed: Feb. 17, 2006

(65) Prior Publication Data

US 2006/0142100 A1 Jun. 29, 2006

Related U.S. Application Data

(62) Division of application No. 10/800,814, filed on Mar. 15, 2004, now Pat. No. 7,008,338.

(60) Provisional application No. 60/455,102, filed on Mar. 13, 2003.

(51) Int. Cl.
*A63B 59/14* (2006.01)

(52) U.S. Cl. ..... 473/563

(58) Field of Classification Search ..... 473/560–563, 473/519, 520

See application file for complete search history.

(56) References Cited

U.S. PATENT DOCUMENTS 3,879,035 A 4/1975 Danchulis et al.
3,970,324 A 7/1976 Howat
4,076,240 A 2/1978 Haddad
4,124,208 A 11/1978 Burns
4,488,721 A 12/1984 Franck et al.
4,504,344 A 3/1985 Helle et al.
5,122,405 A 6/1992 Landi
5,333,857 A * 8/1994 Lallemand ..... 473/561
5,364,095 A 11/1994 Easton et al.
5,395,108 A 3/1995 Souders et al.
5,407,195 A 4/1995 Tiitola et al.
5,593,158 A 1/1997 Filice et al.
5,772,541 A 6/1998 Buiatti (Continued)

FOREIGN PATENT DOCUMENTS

CA 2294301 7/1999

(Continued)

OTHER PUBLICATIONS

"Stick wars heat up at retail", Hockey Business News, Oct. 2002, pp. 1, 10.

(Continued)

*Primary Examiner*—Mark S Graham
(74) *Attorney, Agent, or Firm*—Knobbe, Martens, Olson & Bear, LLP.

(57) ABSTRACT

A hockey stick comprises a shaft and a blade. The blade is configured to impact and exert energy on a hockey puck. The blade comprises a core that is generally enclosed within an outer layer. The core comprises a foam-filled cell structure having cell walls that define foam-filled cells. The cell walls of the core structure extend in a direction generally from the front face toward the rear face of the hockey stick blade.

30 Claims, 13 Drawing Sheets

U.S. PATENT DOCUMENTS

| | | | | |
|---|---|---|---|---|
| 5,863,269 | A | 1/1999 | Filice | |
| 6,001,035 | A | 12/1999 | Roberts | |
| 6,033,328 | A | 3/2000 | Bellefleur et al. | |
| 6,062,996 | A | 5/2000 | Quigley et al. | |
| 6,273,835 | B1 * | 8/2001 | Battis et al. | 473/563 |
| 6,696,001 | B1 | 2/2004 | Quddus | |
| 7,008,338 | B2 * | 3/2006 | Pearson | 473/563 |
| 7,097,577 | B2 | 8/2006 | Goldsmith et al. | |
| 2002/0065154 | A1 | 5/2002 | Goldsmith et al. | |
| 2003/0004019 | A1 | 1/2003 | Lussier et al. | |
| 2003/0104883 | A1 * | 6/2003 | Caron | 473/560 |
| 2003/0119612 | A1 | 6/2003 | Goldsmith et al. | |
| 2004/0198538 | A1 * | 10/2004 | Goldsmith et al. | 473/563 |
| 2004/0235591 | A1 | 11/2004 | McGrath et al. | |

FOREIGN PATENT DOCUMENTS

| | | | |
|---|---|---|---|
| EP | 0 764 453 | A1 | 3/1997 |
| EP | 0 768 907 | B1 | 11/1998 |
| WO | WO 00/32278 | | 6/2000 |
| WO | WO 03/097181 | | 11/2003 |

OTHER PUBLICATIONS

Advertisement for Vector™ 110 hockey stick, "Hockey Business News", Jun. 2003, pp. 24.

Photographs composite stick shafts, hockey sticks and replacement blades, Mission Hockey catalog, 1999.

Photographs of one-piece composite sticks and blades, Mission Roller Hockey catalog, 2003.

Hockey Business News, Feb. 2002, pp. 1, 12-23.

Advertisement for Franklin® Air Core hockey stick, "Hockey Business News", Jun./Jul. 1999, p. 9.

Photographs of hockey sticks and blades, Mission Hockey catalog, 2002.

Photograph of hockey stick shafts and blades, Mission Hockey catalog, 2002.

* cited by examiner

DURABLE HIGH PERFORMANCE HOCKEY STICK

This application is a division of U.S. patent application Ser. No. 10/800,814, filed Mar. 15, 2004, now U.S. Pat. No. 7,008,338 which claims priority to U.S. Provisional Application Ser. No. 60/455,102, filed Mar. 13, 2003. The entirety of each priority application is hereby incorporated by reference.

BACKGROUND OF THE INVENTION

1. Field of the Invention

This invention relates to sporting sticks and more particularly relates to sporting sticks configured to impact a sporting implement.

2. The Related Art

Hockey is a fast moving, competitive game. Hockey players use hockey sticks to control the puck or ball during the game. Players also use the sticks to shoot the puck during the game, as well as to knock the puck away from opposing players.

Hockey sticks generally include a handle portion and a blade portion. The handle portion is generally elongate and is specially configured to be held by the player during the game of hockey. The blade portion extends from a distal end of the handle portion and is shaped to allow a player to control and shoot the hockey puck with the blade.

In some embodiments, the hockey stick blade comprises a foam core that is surrounded by a hard outer layer. Often, the outer layer includes a composite material such as fiberglass or carbon fiber.

While playing hockey, a player often controls and shoots the puck with the blade. One particular type of shot is a "slap shot," which is an extreme shot in which a player hits the puck with great force. A slap shot is the fastest of all hockey shots. Dury a slap shot, a player makes a sweeping motion with an accentuated backswing to shoot the puck. Another category of extreme shot is the "one-timer," in which a player shoots a puck (usually from a teammate's pass) without taking the time to stop and control the puck. Usually, a one-timer is in the form of a slap shot. Slap shots and other one-timers typically impart high energy and speed into the puck, and thus the impact between the puck and the blade during one-timers can result in high forces in a "strike zone" of the blade where the puck and blade meet. During this contact, the composite outer layer of the blade may deform somewhat. However, the outer layer is supported by the foam core, and thus the impact force and corresponding deformation is distributed. In a typical foam-core hockey stick blade, the foam tends to breakdown after repeated impacts due to slap shots and other extreme shots. Such foam breakdown creates a void behind the composite layer in the strike zone. Because of this void, the composite layer is no longer supported by foam. Depending on the amount of force and repetition of extreme shots, the unsupported composite layer will break down and the blade will fail. Such blade failure is especially prevalent in very light, high performance hockey sticks.

SUMMARY OF THE INVENTION

Accordingly, there is a need in the art for a durable high performance hockey stick that can withstand repeated extreme shots such as slap shots without prematurely breaking, yet is light enough to perform well as a hockey stick.

In accordance with one embodiment, the present invention provides a hockey stick comprising a shaft and a blade. The blade has a core substantially enclosed within an outer layer, which comprises a primary impact layer and a secondary impact layer that generally oppose one another. The core comprises a foam-filled cell structure comprising a plurality of cell walls. The core is arranged between the primary and secondary impact layers and is configured so that longitudinal axes of the cell walls generally extend in a direction from the primary impact layer toward the secondary impact layer.

In accordance with another embodiment, a method is providing for making a sporting implement blade portion configured to withstand repeated impacts. In accordance with the method, a core is provided. The core comprises a foam-filled cell structure comprising a plurality of cell walls that cooperate to define a plurality of cells therebetween. The cell walls are arranged so that each cell has a longitudinal axis. In accordance with the method, the cell structure is enclosed in a generally rigid outer layer having an impact surface. Further, the cell structure is arranged relative to the outer layer such that the longitudinal axis is generally transverse to the impact surface.

In still another embodiment, prior to enclosing the core within the outer layer the foam is treated so that it will preferentially expand in a desired direction during curing. In another embodiment, at least some of the cell walls are substantially in contact with the outer layer. In further embodiments a first zone of the core has different structural properties than does a second zone.

In accordance with yet a further embodiment, a sports stick is provided having a handle portion and a contact portion. The contact portion is configured to impact a sports implement and has a primary impact face and a secondary impact face that generally oppose one another. The contact portion further comprises a core substantially surrounded by a cover. The core comprises a celled structural member constructed of a different material than the cover and comprising a plurality of cell walls, which are arranged to extend generally in a direction from the primary impact face to the secondary impact face.

In still a further embodiment, a generally rigid elongate spine extends between the primary and secondary impact faces, and the contact portion has an upper core and lower core that are separated from one another by the elongate spine. In still another embodiment, the upper core has different structural properties than the lower core. In some embodiment, the spine comprises a composite made up of fibers entrained in a cured resin. In yet further embodiment, the primary impact face comprises an insert.

DETAILED DESCRIPTION OF THE PREFERRED EMBODIMENT

Figures 1, 2, 3:
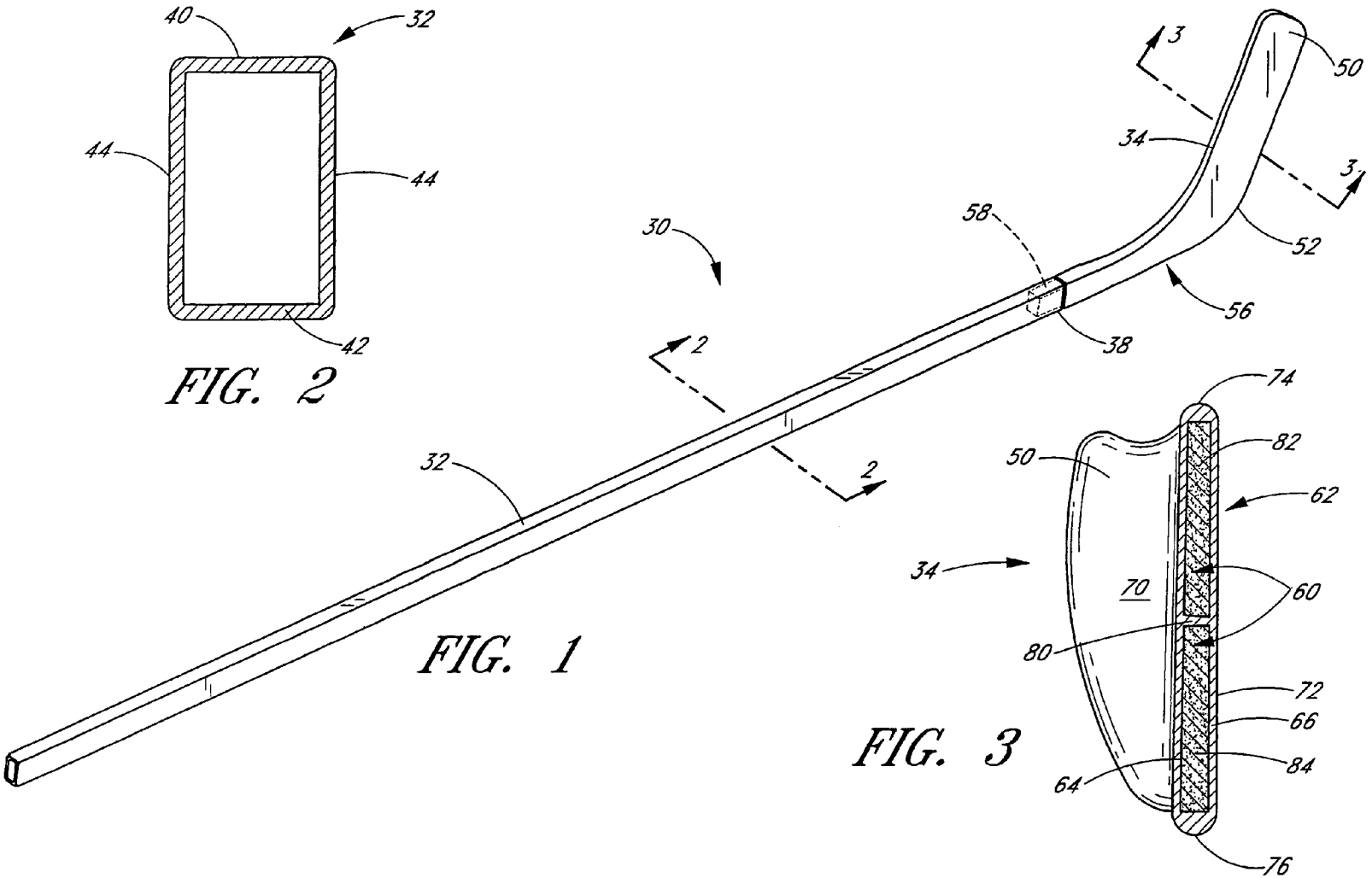
FIG. 1 is a perspective view of a preferred embodiment of a hockey stick having features of the present invention.
FIG. 2 is a cross-sectional view of the hockey stick of FIG. 1 taken along line 2-2.
FIG. 3 is a cross-sectional view of a blade of the hockey stick of FIG. 1 taken along line 3-3.

With reference first to FIGS. 1-3, a hockey stick 30 is provided having a shaft 32 and a blade 34. The shaft 32 has a proximal or butt end 36 and a distal or heel end 38. The blade 34 is connected to the shaft heel end 38 and extends therefrom.

The shaft 32 preferably is generally rectangular in cross-section and has opposing upper and lower walls 40, 42 and opposing side walls 44 extending between the upper and lower walls 40, 42. Preferably, the shaft 32 is substantially hollow and is constructed of composite materials such as fiberglass, carbon fiber and/or an aramid such as Kevlar. Most preferably, the composite construction comprises fibers entrained in a cured resin. It is to be understood that other types and combinations of materials can be used to construct the hockey stick shaft 32. For example, a hockey stick shaft can be constructed of wood, polymers, metals such as aluminum, and composite materials. Combinations of such materials can also be used.

Figure 4A:
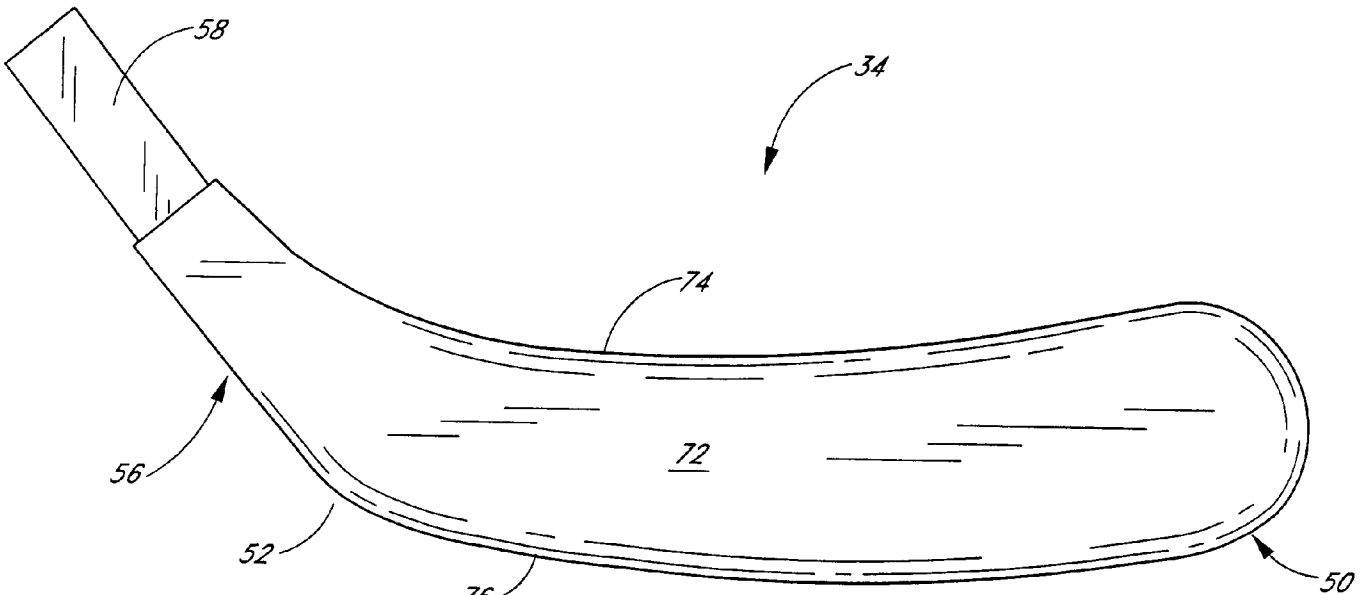
FIG. 4*a* shows a detachable blade portion of a hockey stick.
Figure 4B:
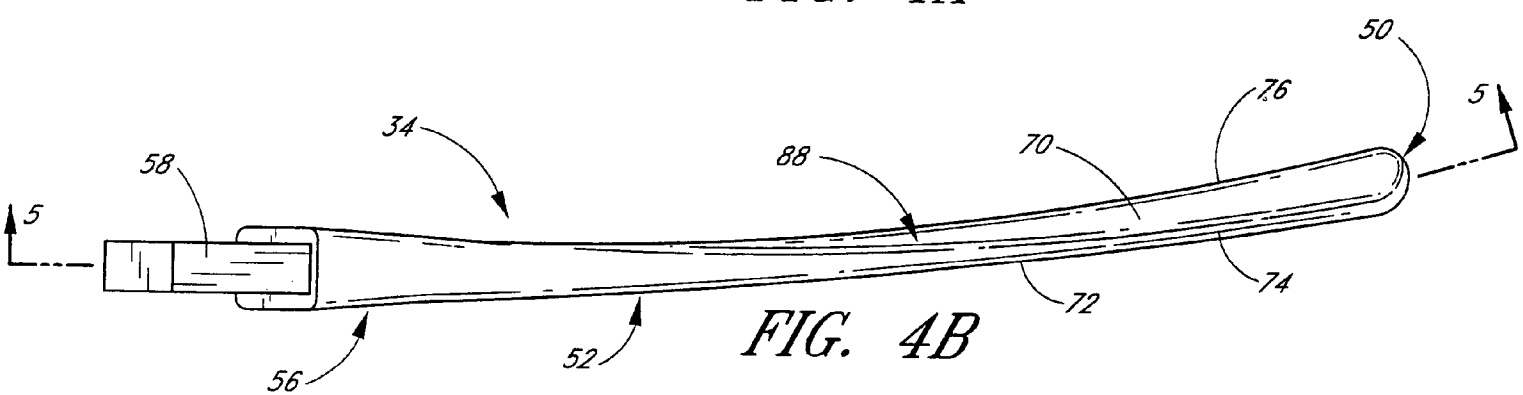
FIG. 4*b* shows a top view of the blade of FIG. 4*a*.

With reference next to FIGS. 3 and 4*a-b*, the blade 34 in the illustrated embodiment is formed separately from the handle 32. The illustrated blade 34 has a toe portion 50 and a heel portion 52. A hosel portion 56 extends from the heel 52 and includes a tenon 58. Preferably, the tenon 58 is sized and configured to fit into the hollow heel end 38 of the shaft 32. With the tenon 58 inserted into the shaft 32, the blade 34 is secured to the shaft 32. Preferably, a glue such as epoxy and/or a mechanical fastener secures the blade in place relative to the shaft.

With particular reference to FIG. 3, the blade 34 preferably comprises a core 60 that is generally enclosed within an outer layer 62. In the illustrated embodiment, the blade 34 comprises a foam core 60 generally enclosed within a layer 62 of composite material. As illustrated, the composite outer layer 62 comprises a primary or front laminate layer 64 disposed generally opposite a secondary or back laminate layer 66. Correspondingly, the blade 34 has a primary or front face 70 and a secondary or back face 72. Further, the blade 34 has a top edge 74 and a bottom edge 76.

In some embodiments, including the illustrated embodiment, a spine 80 extends between the primary and secondary laminate layers 64, 66. Preferably, the spine 80 comprises the same materials as the laminate layers, and preferably is disposed generally centrally between the top and bottom edges 74, 76. In embodiments employing a spine 80, the foam core 60 is divided into an upper foam core 82 and a lower foam core 84.

With particular reference to FIGS. 3 and 4*b*, the blade 34 preferably is contoured. More specifically, the blade 34 preferably is contoured so that the front face 70 has a generally concave shape. Such curvature may enhance puck control. Of course, it is to be understood that blade curvature can be accomplished in various configurations, and, in some embodiments, hockey stick blades are not curved. With reference also to FIG. 4*a*, a strike zone, or impact zone 88, is defined generally between the toe and heel portions 50, 52 of the blade 34, and corresponds generally to the area of the blade that usually strikes the puck during a shot such as a slap shot.

Hockey stick blades can be made by several different processes and materials. As discussed above, the illustrated blade 34 comprises a core 60 generally enclosed in a layer 62 of composite material. Preferably, the foam core is formed and shaped to a desired shape prior to being covered with the outer layer. For example, in one embodiment, upper and lower foam cores are machined from a structural foam sheet stock. In another embodiment, a foam core is molded in a specially-shaped mold by injecting expanding structural foam into the mold. Preferably, the foam comprises an expanding urethane foam. It is to be understood that any acceptable type of expanding structural foam can be appropriately used as a core for a hockey stick blade.

Any one of many different processes can be used to enclose the foam core 60 with a relatively rigid outer layer 62. One such process is referred to as a resin transfer molding (RTM) process. In this process a woven sock of composite material such as carbon fiber is pulled over the upper foam core 82, another woven sock is pulled over the lower foam core 84, and yet another woven sock is pulled over both of the sock-covered foam cores. The core/sock assembly is placed in a mold, which forms the assembly into the desired shape of the hockey stick blade. Resin is injected into the composite socks while the assembly is in the mold. Heat and pressure are applied to cure the resin. During the curing process, the foam core typically expands due to the heat. The expansion of the foam core coupled with the pressurized mold exerts an appropriate amount of pressure on the resin and fibrous laminate layers to produce appropriate and strong curing of the composite material.

In accordance with another preferred embodiment for manufacturing the hockey stick blade, layers of composite such as carbon fiber fabric that have already been impregnated with a resin (pre-preg) are laid up around the foam core 60 and placed in a mold. The mold is closed and pressure and heat are applied to cure the assembly. Due to the pressure of the mold, coupled with the expansion of the foam core, pressure is applied to the composite material from both the mold and the core, and thus the composite is formed into an appropriately cured and hardened laminate 62 enclosing the core 60.

Figure 5:
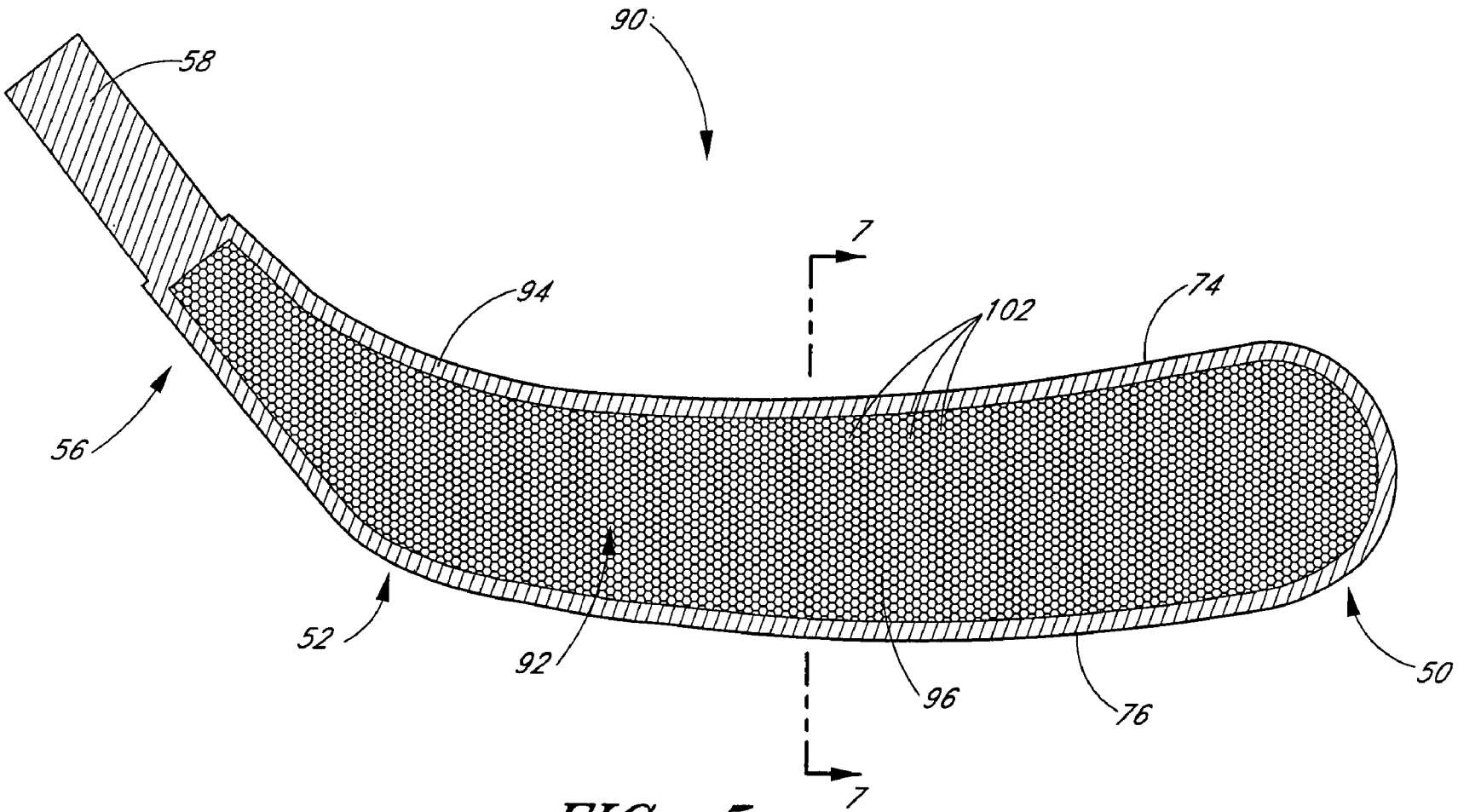
FIG. 5 is a cross-sectional view of a blade taken along line 5-5 of FIG. 4*b*, and shows a core comprising a cell structure.
Figure 6:
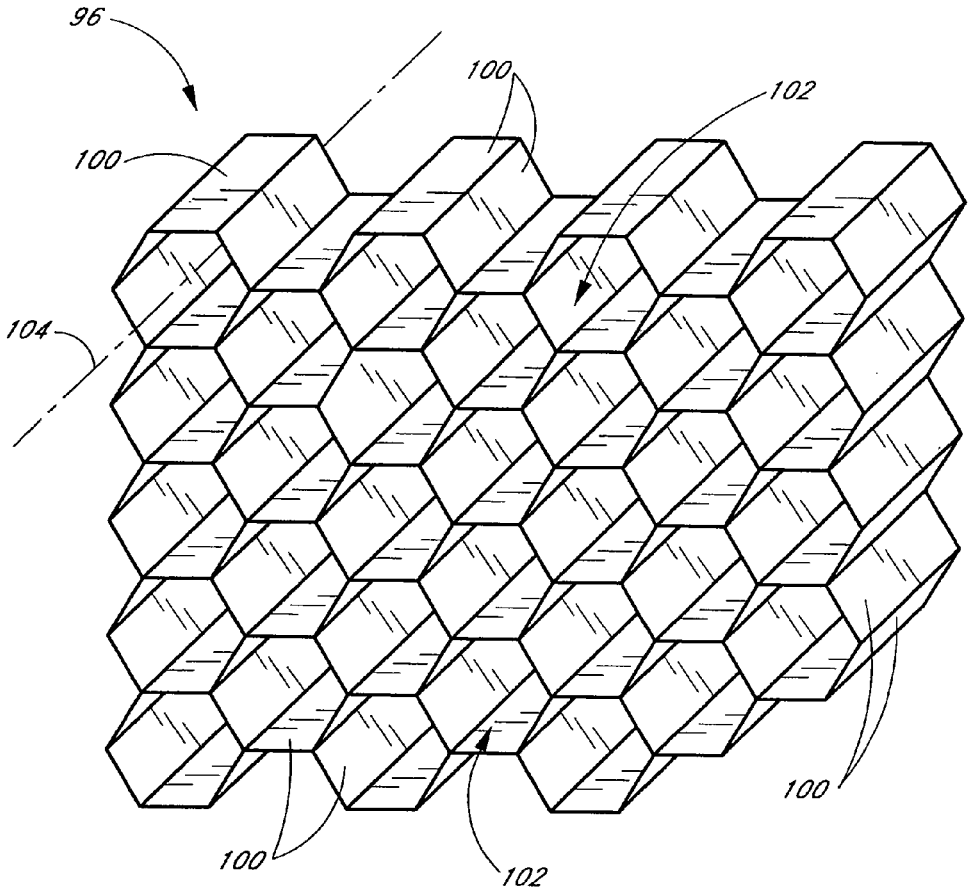
FIG. 6 is a perspective view of a portion of the cell structure employed in the embodiment shown in FIG. 5.
Figure 7:
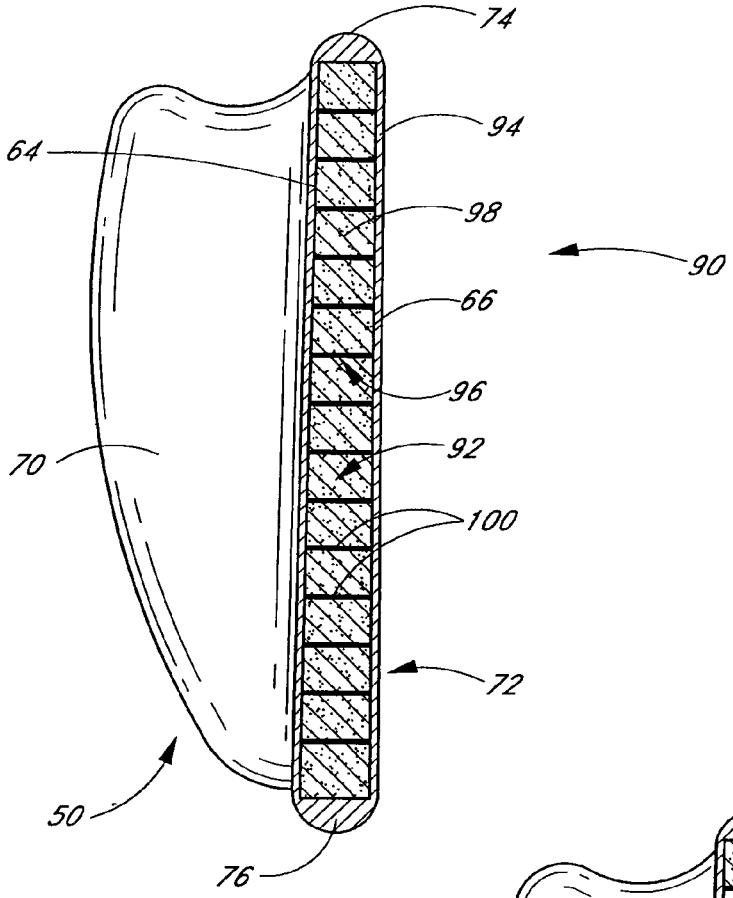
FIG. 7 is a cross-sectional view of the embodiment shown in FIG. 5 taken along line 7-7.

With reference next to FIGS. 5 and 7, cross-sectional views of a hockey stick blade 90 are shown. The illustrated blade 90 comprises a core 92 enclosed within an outer layer 94. As shown, the core 92 comprises a celled reinforcement structure 96. Preferably the cell structure 96 is filled with an expanding structural foam 98 such as urethane foam. With reference also to FIG. 6, the illustrated cell structure 96 (shown without a foam filling) comprises several elongate cell walls 100 that cooperate to form a series of enclosed cells 102. Preferably the cell walls 100 are elongate along an axis 104 of the cell.

In the illustrated embodiment, the cell structure 96 comprises an aramid honeycomb structure constructed of Kevlar ECA-I ⅛-3.0 Commercial Grade, which is available from DuPont. The diameter of the cell structure is about $\frac{1}{8}^{th}$ inch. Aramid's tear resistance, crushability and vibration dampening properties are particularly preferred.

To manufacture the blade embodiment 90 depicted in FIGS. 5-7, the honeycomb cell structure 96 preferably is cut by machining, laser cutter, or any other acceptable method to generally approximate the shape of the blade core 92. In the illustrated embodiment, the blade 90 generally tapers from the heel 52 to the toe 50, thus the core 92 will be somewhat thicker at the heel 52 than at the toe 50. In some embodiments, the core 92 is somewhat thicker toward the bottom edge 76 than toward the top edge 74.

After the cell structure 96 is cut to shape, it is inserted into a core mold, and an expanding structural foam 98, preferably polyurethane foam, is injected into the mold. The mold is closed and pressure is applied so as to control the density of the cured and expanded structural foam. After curing, the foam-filled cell structure is in a desired shape for the foam core 92 of the blade 90. Preferably the volume of expanding structural foam injected into the mold combined with the pressure applied by the mold and other manufacturing factors are configured so that the density/structural rating of the foam is between about 5-30#. More preferably the foam density is between about 10-20#, and most preferably the foam density is between about 15-20#.

With continued reference to FIGS. 5-7, after the foam-filled cell structure 96 is formed into the core 92, it is enclosed within one or more layers 94 of the composite material, such as by the pre-preg process discussed above. As can be appreciated, the cured composite is a very rigid material. The structural foam 98 is also fairly rigid, yet is more pliable than the composite material 94. The cell structure 96 preferably is more rigid along its longitudinal axis 104 than the structural foam 98, yet less rigid than the laminate material 62. In another embodiment, the cell structure is more compliant in compression along its longitudinal axis than is the structural foam. The cell structure 96 contains the foam 98 within cells 102. The foam is better able to resist crushing, and propagation of foam crushing is contained by the cell walls 100.

With continued reference to FIG. 7, preferably the core 92 is configured so that cell walls 100 extend between the front and back laminate layers 64, 66 of the blade 90. As such, strike forces exerted on the front 70 of the blade are communicated through the cell walls 100 to the back laminate layer 66, and thus forces are distributed throughout the blade 90. Further, the cell structure 96 reinforces and contains the structural foam 98 so that upon extreme strikes, such as slap shots, the foam better resists crushing. As such, the blade core 92 is more durable and better supports the laminate 94. Accordingly, durability of the hockey stick blade 90 is increased.

In the embodiment discussed above, the foam core tends to expand during curing due to the heat of the mold. Such secondary expansion applies a pressure to the composite outer layer that, combined with the external pressure applied by the mold, aids in maintaining compact structural integrity of the laminate layer during curing. It is generally understood that secondary expansion of some structural foams decreases as the density of the foam increases. As such, in one embodiment, a foam core having a structural density between about 15#-20# is shaped to have a dimension that meets or, at least in portions of the core, exceeds the final dimension desired for after curing within the laminate layer.

With particular reference again to FIG. 5, in the illustrated embodiment the core 92 does not extend into the tenon area 58 of the blade 90. Instead, the tenon area 58 comprises a thick layer of composite and/or another rigid core member. It is to be understood that, in other embodiments, the cell structure of the core can extend into the tenon area of the blade. Further, in other embodiments, the entire core or only a portion of the core can include the cell structure.

Figure 8:
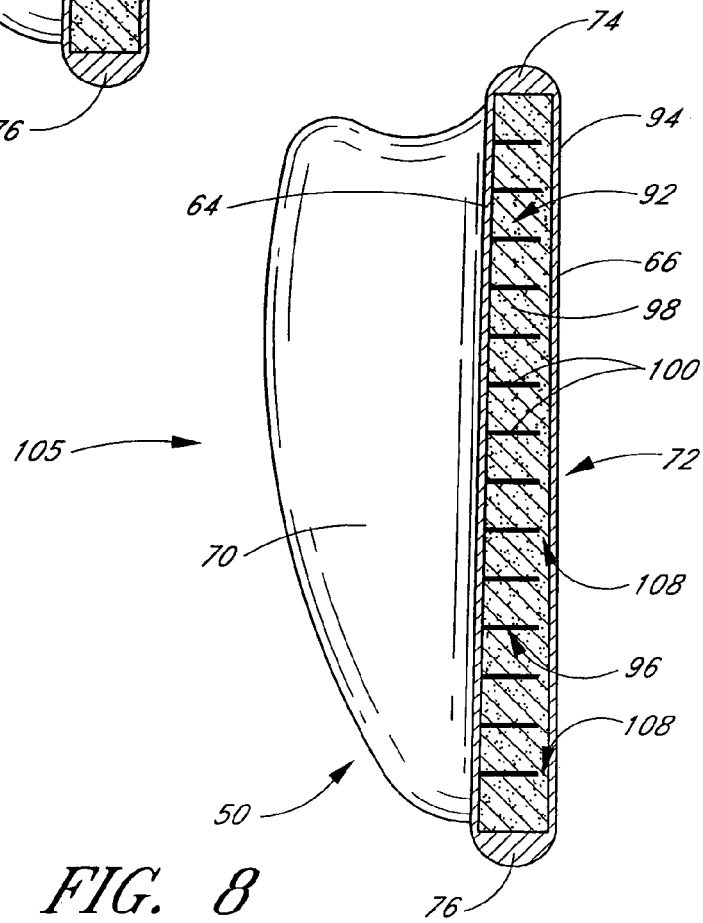
FIG. 8 is a cross-sectional view of another embodiment of a hockey stick blade.

With reference also to FIG. 8, another embodiment of a blade 105 is shown in which the cell walls 100 do not extend substantially all the way between the front and back laminate layers 64, 66. In this embodiment, during curing of the blade composite outer layer 94, the structural foam 98 filling the cell structure 96 expands such that the foam becomes somewhat thicker than the cell walls 100. As such, the expanded foam 98 creates a space 108 between the cell walls 100 and the back laminate layer 66 so that the cell walls 100 do not reach substantially all the way to the back laminate layer 66. In the illustrated embodiment, the foam 98 is treated to selectively expand towards the back layer 66 rather than toward the front layer 64 so that the cell walls 100 substantially contact the front laminate layer 64 and most or all of the foam expansion beyond the cell walls 100 is directed generally toward the back of the blade 105. In this embodiment, forces are still communicated from the front laminate layer 64 to the back laminate layer 66. However, because the cell walls 100 substantially contact the front laminate layer 64, the cell structure 96 supports the front laminate layer to a greater extent than it supports the back laminate layer.

In order to construct the embodiment shown in FIG. 8, the foam-filled core 92 is treated to preferentially expand toward the back face 72 prior to enclosing the core 92 within the outer layer 94. During curing of the core, a curing layer tends to form on the foam 98. Preferably, prior to enclosing the core within a composite outer laminate layer 94, the back side of the foam core 98 is cut or roughened by sanding, machining or the like in order to weaken and/or remove the curing layer on the back of the foam core. Thus, if the foam 98 expands due to heat during final curing of the hockey stick blade, the foam will preferentially expand in the direction toward the roughened side. As such, foam expansion is substantially confined toward the back laminate layer 66 rather than toward the front laminate layer 64. More specifically, more foam expansion is directed adjacent and towards the back laminate layer than toward the front laminate layer. Accordingly, in a preferred embodiment there is less, if any, space 108 between the cell walls 100 and the front layer 64 than between the cell walls 100 and the back layer 66.

As shown in FIGS. 5-7, the cell structure 96 preferably is disposed within the blade 90 so that the longitudinal axis 104 of the cell walls 100 generally extends in a direction from the primary impact face 70 toward the secondary face 72 of the blade 90. This arrangement aids containment of the foam 98 by the cell structure 96 as well as creating a force distribution bridge between the primary and secondary faces 70, 72. Most preferably the cell structure 96 is configured so that the longitudinal axis is generally perpendicular to at least the front face 70.

Figure 9:
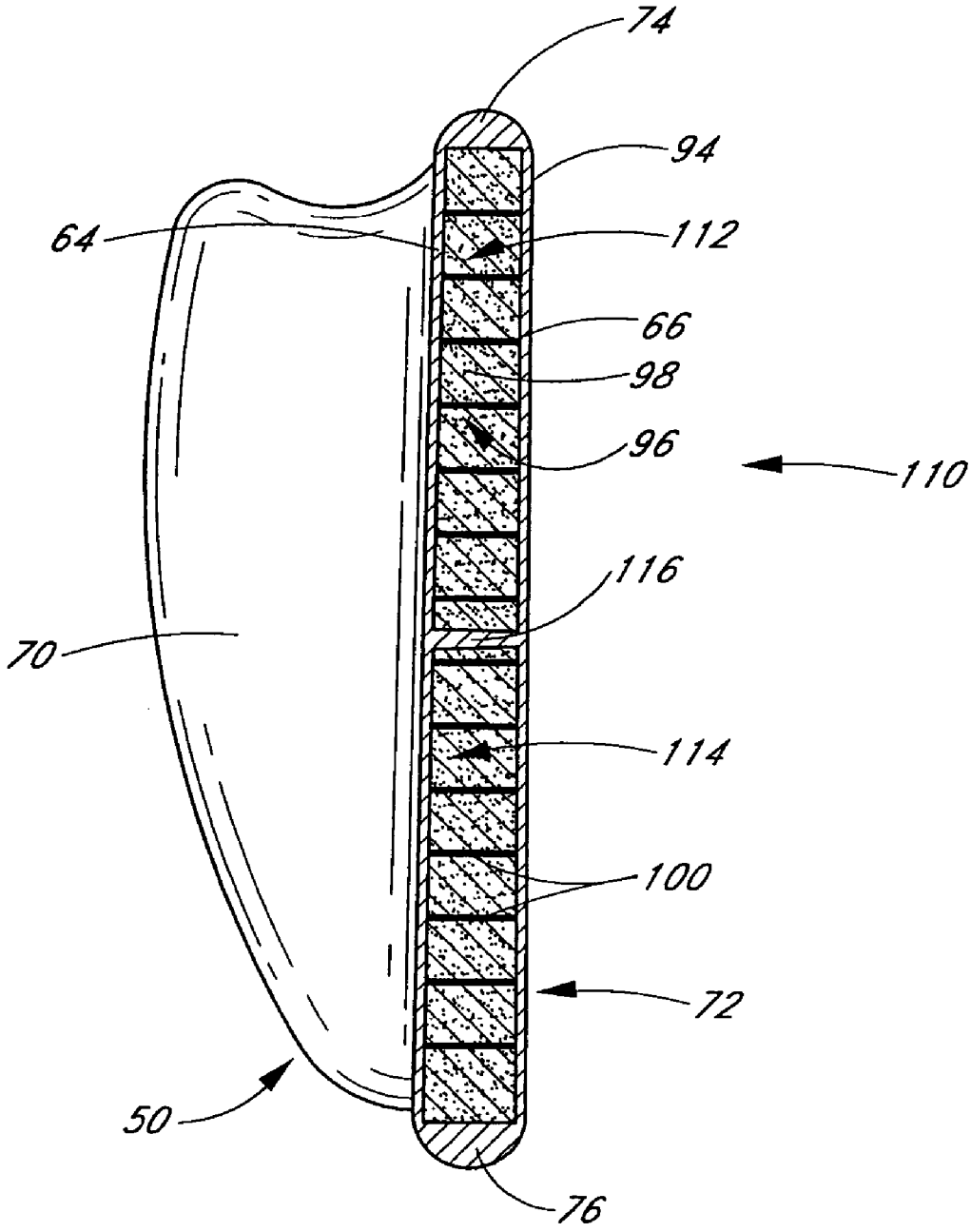
FIG. 9 is a cross-sectional view of still another embodiment of a hockey stick blade.

The embodiment illustrated in FIG. 7 does not employ a spine. Instead, the core 92 comprises a single foam-filled cell structure 96. With reference next to FIG. 9, another embodiment of a hockey stick blade 110 is shown wherein an upper core 112 and a lower core 114 are separated by a spine 116 extending therebetween and from the primary face 70 to the secondary face 72. Preferably, the spine 116 is constructed of the same material that makes up the primary and secondary layers 64, 66. In the illustrated embodiment, the same cell structure material 96 shown and discussed in connection with FIGS. 5-7 is filled with an expanding urethane foam 98 to create the upper and lower cores 112, 114. The spine 116 extends from the primary layer 64 to the secondary layer 66 and as such the spine 116 is quite rigid. Preferably, the cell structure 96 and structural foam 98 are more pliable than the spine 116.

Figures 10A, 10B, 11:
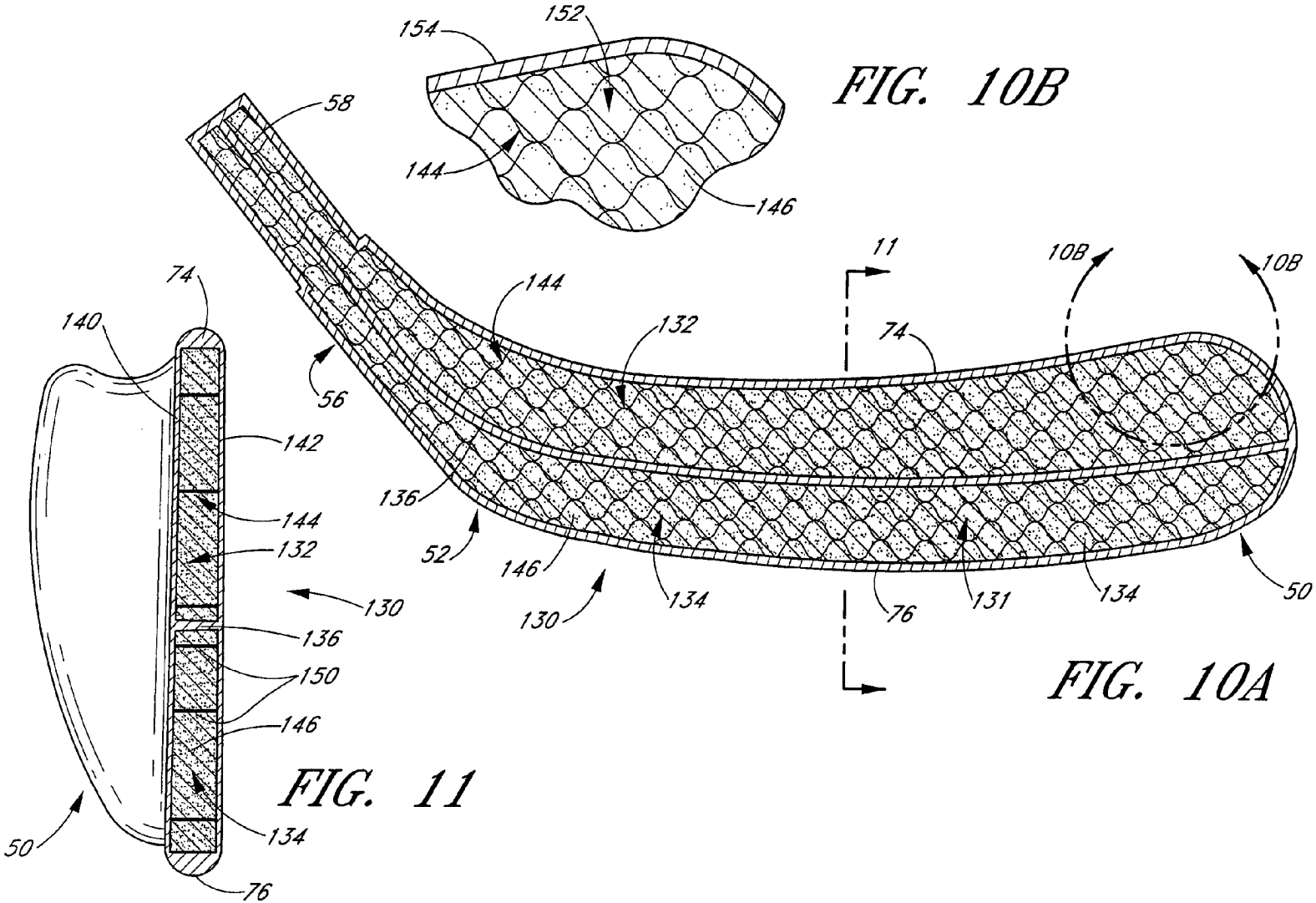
FIG. 10*a* shows another embodiment of a hockey stick blade, and depicts a core comprising a cell structure.
FIG. 10*b* shows an enlarged view of a portion of the blade of FIG. 10*a*, taken along line 10*b*-10*b*.
FIG. 11 is a cross-sectional view of the hockey stick blade of FIG. 10*a* taken along line 11-11.

With reference next to FIGS. 10*a*, 10*b* and 11, another embodiment of hockey stick blade 130 is shown. In the illustrated embodiment, the hockey stick blade 130 comprises an upper and lower core 132, 134 that are separated from each other by a spine 136 that extends between a core 131 made up of primary and secondary laminate faces. The illustrated core 131 comprises a nylon-based cell structure 144 that has been filled with an expanding polyurethane foam 146. In the illustrated embodiment, cell walls 150 of the cell structure 144 comprise an undulating structure. Adjacent undulating cell walls engage one another to form substantially closed cells 152. A diameter of the cells 152 is about ⅜ inch.

In the illustrated embodiment, the cell structure 144 is filled with an expanding polyurethane foam 146 and is obtained as a sheet stock wherein the foam has a structural rating between about 10-20#. More preferably the foam structural rating is between about 17 and 19#. In the illustrated embodiment, the foam-filled cell structure 144 is provided in a sheet stock wherein the foam has a structural rating of about 18#. The sheet stock is then milled to form a desired core shape 131, 132, 134. In the illustrated embodiment, cores 132, 134 are inserted into a mold and enclosed within a composite outer layer 154 through, for example, an RTM or pre-preg process. Most preferably, the cores 132, 134 are encased in a carbon fiber composite material 154.

The above-discussed embodiments comprise cell structures constructed of Kevlar and a nylon-based material, respectively. It is to be understood, however, that other types of materials can also be appropriately used. For example, polymers, metals and phenolic-based papers can also be used. Further, the cell structure can comprise various shapes, including the honeycomb structure 96 shown in FIGS. 5-7, the intersecting undulating wall structure 144 shown in FIGS. 10-11, and variations thereof such as multi-sided or rounded cells. Other structure configurations are discussed below, and it is anticipated that still further cell structure configurations, such as a plurality of cylinders or the like, are appropriate.

Figures 12A, 12B:
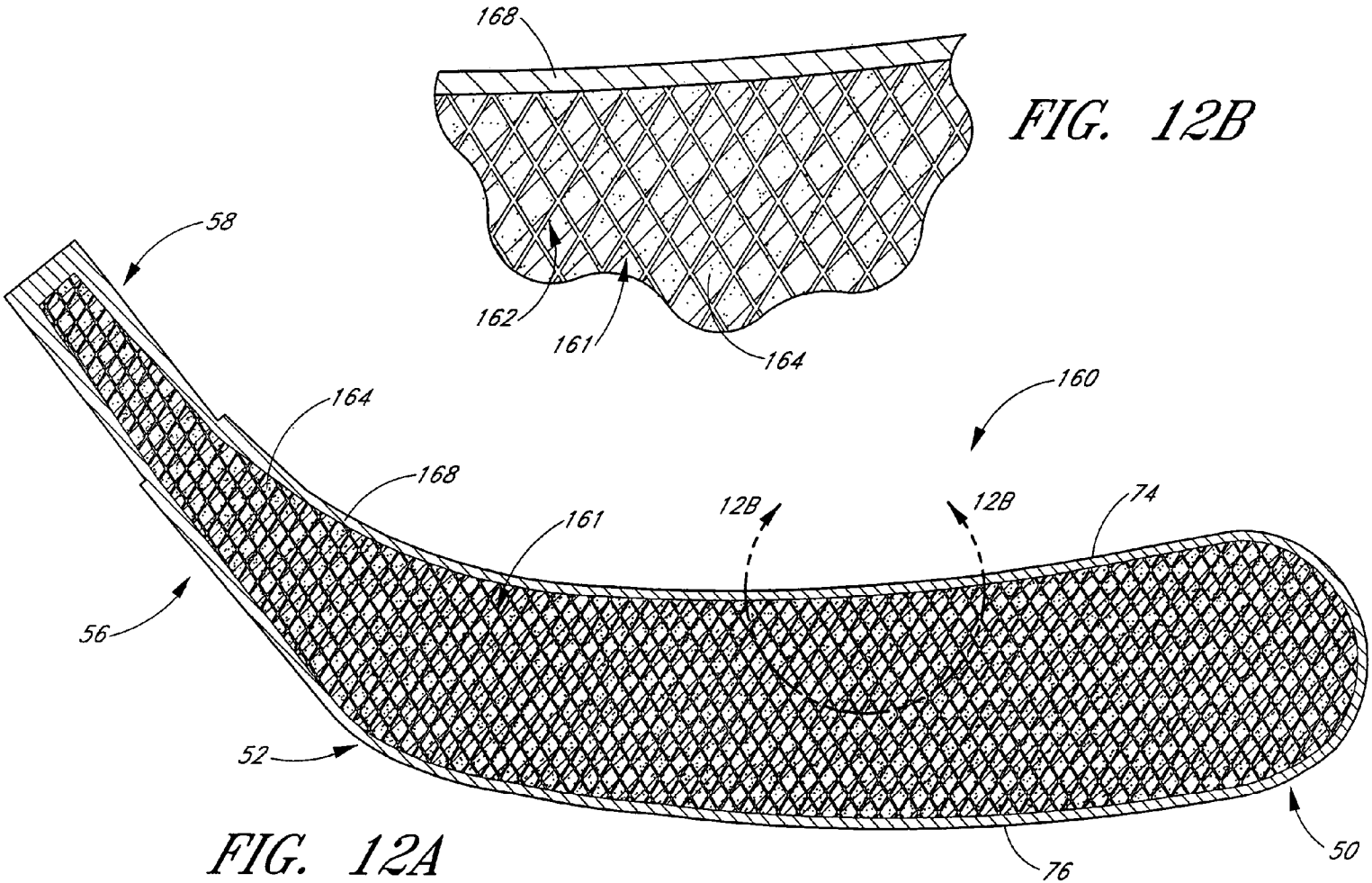
FIG. 12*a* is another embodiment of a hockey stick blade having a core with a cell structure.
FIG. 12*b* shows an enlarged view of a portion of the blade of FIG. 12*a*, taken along line 12*b*-12*b*.

With reference next to FIGS. 12*a* and *b*, yet another embodiment of a hockey stick blade 160 is shown having a core 161 comprising a molded plastic cell structure 162. In the illustrated embodiment, the molded plastic cell structure 162 has a diamond pattern. Preferably the cell structure 162 is molded or cut to the desired blade shape and then filled with structural foam 164. The core 161 is then encased in a composite material 168 or other material that is suitable for a hockey stick blade.

With particular reference to FIG. 12*a*, the illustrated core 161 is shaped to generally correspond with the outside dimensions of the blade 160 except in the hosel portion 54 in and around the tenon 58. Instead, the composite layer 168 is much thicker through the hosel 54 and the composite core 161 does not necessarily follow the outer dimension of the blade 160. It is to be understood that, in other embodiments, the core shape may vary relative to the outer blade shape.

Figures 13A, 13B:
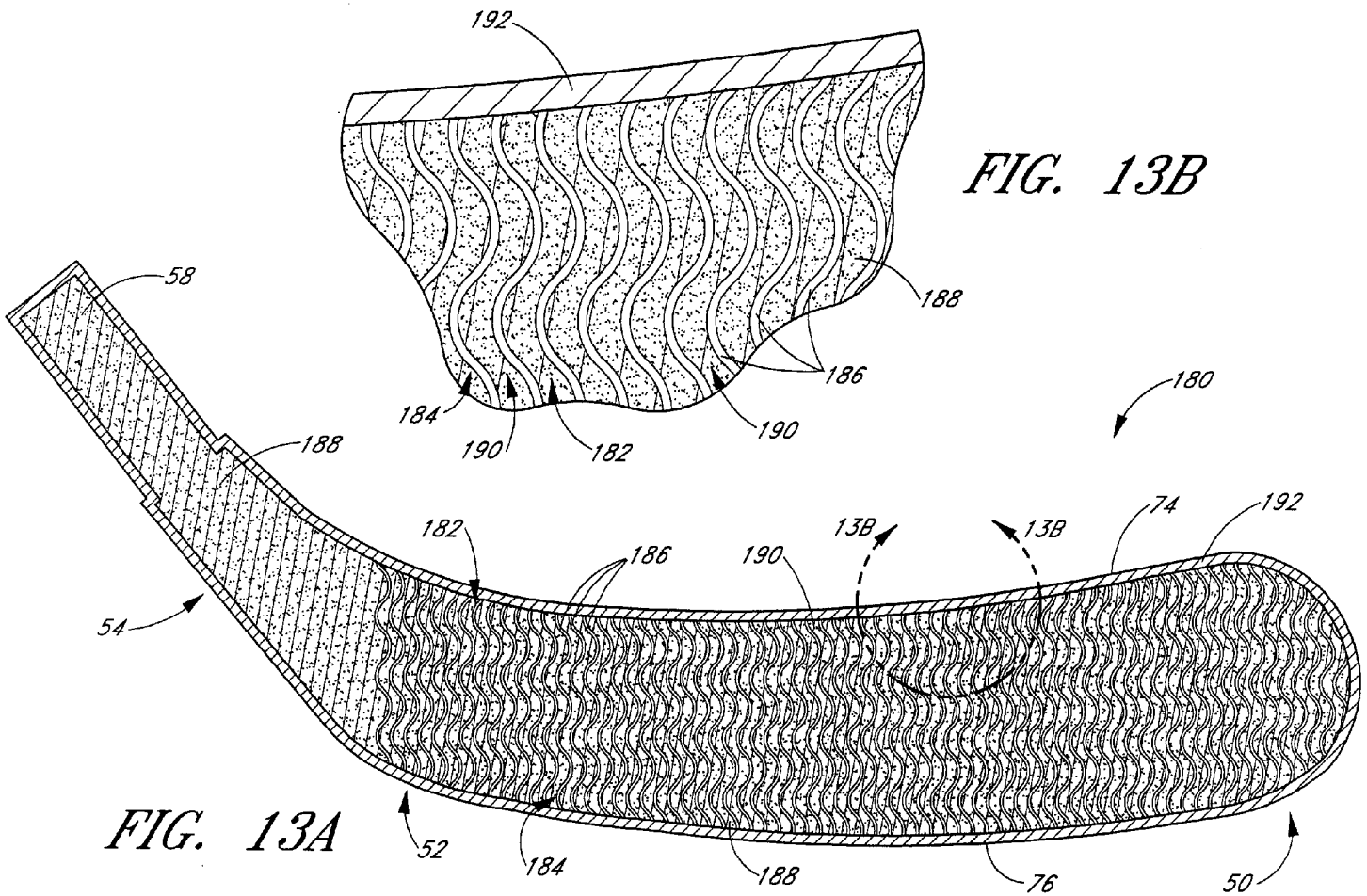
FIG. 13*a* shows another embodiment of a hockey stick blade having a core with a cell structure.
FIG. 13*b* shows an enlarged view of a portion of the blade of FIG. 13*a*, taken along line 13*b*-13*b*.

With reference next to FIGS. 13*a* and *b*, another embodiment of a hockey stick blade 180 is presented. In the illustrated embodiment, the blade 180 has a core 182 comprising a cell structure 184. The cell structure 184 comprises a series of reinforcement walls 186 that extend generally from the upper edge 74 to the lower edge 76 of the blade 180 and from the front face to the back face of the blade. Preferably the reinforcing walls 186 are generally undulating, but adjacent walls 186 are spaced from one another and are not connected to one another. In the illustrated embodiment, structural foam 188 fills the cell space 190 between adjacent reinforced walls 186. As in the embodiments discussed above, the core 182 preferably is encased in a suitable outer layer 192 such as a composite or molded plastic layer.

In the embodiment illustrated in FIGS. 13*a* and *b*, the reinforcement walls 186 are arranged in an "open" cell structure. An open cell structure 184 is considered a structure in which reinforcement walls 186 define a cell 190 between and including the walls 186, yet the walls 186 do not intersect to enclose the cells 190. In the embodiments illustrated in FIGS. 5-7, 10-11 and 12, the cores comprise a closed cell structural members in which the cell walls intersect to form a plurality of closed cells.

It is to be understood that several types and shapes of cell structures can be appropriately employed in accordance with the principles described herein. Additionally, a broad range of distances between adjacent cell walls can suitably be employed. For example, cell walls preferably are between about 1/20 in. to ½ in. apart. More preferably, cell walls are between about 1/16 in. to ⅜ in. apart. In additional embodiments, cell walls are between about ⅛ in. to ¼ in. apart. Additionally, it is to be understood that both closed cell and open cell constructions may be used as desired.

Figure 14:
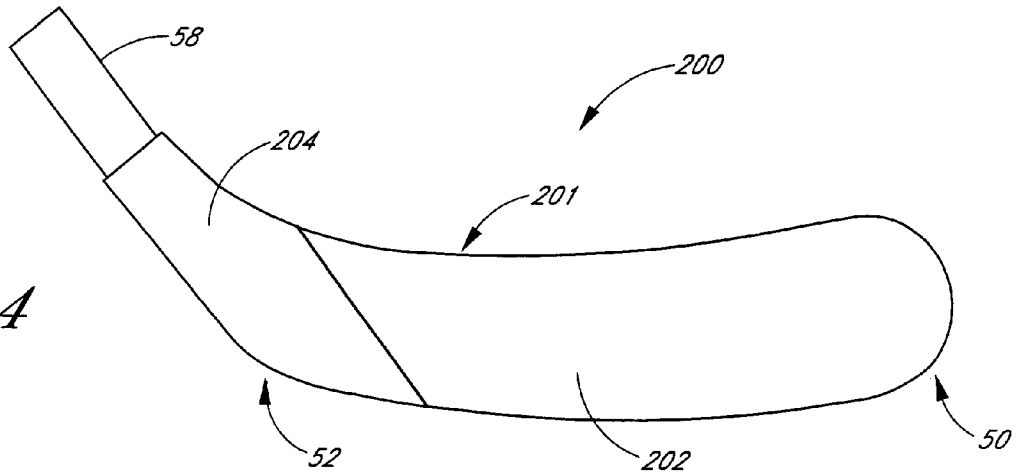
FIG. 14 is a schematic view depicting a hockey stick blade core comprising stick blade than one type of material.

With reference next to FIG. 14, a schematic representation of yet another embodiment of a hockey stick blade 200 is illustrated. In the illustrated embodiment, the core 201 of the blade comprises two distinct regions 202, 204. The first region, termed a strike zone 202, makes up most of the blade 200. This region generally corresponds to the area of the blade that tends to contact the hockey puck when controlling and shooting the puck. The second region, termed the hosel zone 204, is arranged generally from the heel portion 50 of the blade 200 upward toward the tenon of the blade 58. This part of the blade generally is not involved in high impact, extreme shots. In the illustrated embodiment, the core 201 in the strike zone 202 comprises a cell structure and a relatively dense urethane foam, but the core 201 in the hosel zone 204 does not comprise the cell structure. In yet another embodiment, the hosel zone 204 of the core is formed of a foam that is less dense than the foam in the strike zone 202 of the core. In still another embodiment, neither zone employs a cell structure, but the strike zone 202 of the core comprises a denser foam than the hosel zone 204.

Figure 15:
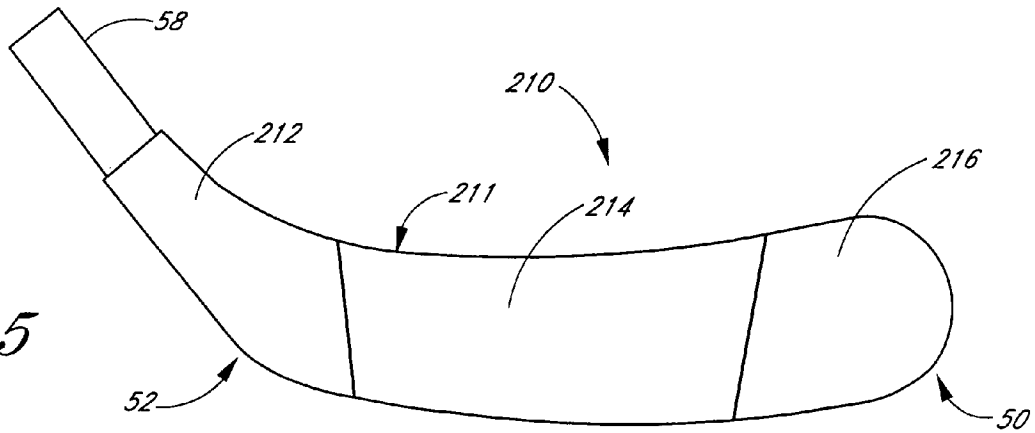
FIG. 15 is a schematic view depicting yet another embodiment of a hockey stick blade core comprising a plurality of materials having different properties.

With reference next to FIG. 15, yet another embodiment of a hockey stick blade 210 is shown schematically. In this embodiment, the blade's core 211 is divided into three zones, a hosel zone 212, a strike zone 214, and a toe zone 216. The strike zone 214 is disposed generally centrally within the blade 210, and comprises the area that tends to be used for the most extreme hockey shots. As such, it is constructed of the strongest material. For example, the strike zone 214 of the core 211 may include a cell structure and a relatively dense foam. As in the embodiment discussed above, the hosel zone 212 is generally arranged from the heel 52 of the blade 210 to the tenon 58 of the blade. Preferably the hosel zone 212 of the core 211 is formed of a lighter and perhaps less structurally-strong material than the strike zone 214. Similarly the toe zone 216, which is oriented generally near the toe 52 of the blade 210, is not used for extreme shots as much as the strike zone 214. Thus, in one illustrated embodiment, the toe zone 216 of the core 211 comprises a material that is lighter and perhaps not as structurally strong as the material of the strike zone 214. This may be accomplished in any desired manner such as by not including a cell structure in the toe zone 216, or by including a cell structure with a greater distance between adjacent cell walls. Additionally, a lighter density structural foam may be used in the toe zone 216 and/or the hosel zone 212 than is used in the strike zone 214, with or without a cell structure.

With continued reference to FIG. 15, in one embodiment, the hosel zone 212 comprises a structurally stronger material than the toe zone 216. In another embodiment, the toe zone 216 and hosel zone 212 comprise structurally similar core materials. In a still further embodiment the toe zone 216 comprises a structurally stronger material than the hosel zone 212.

Figure 16:
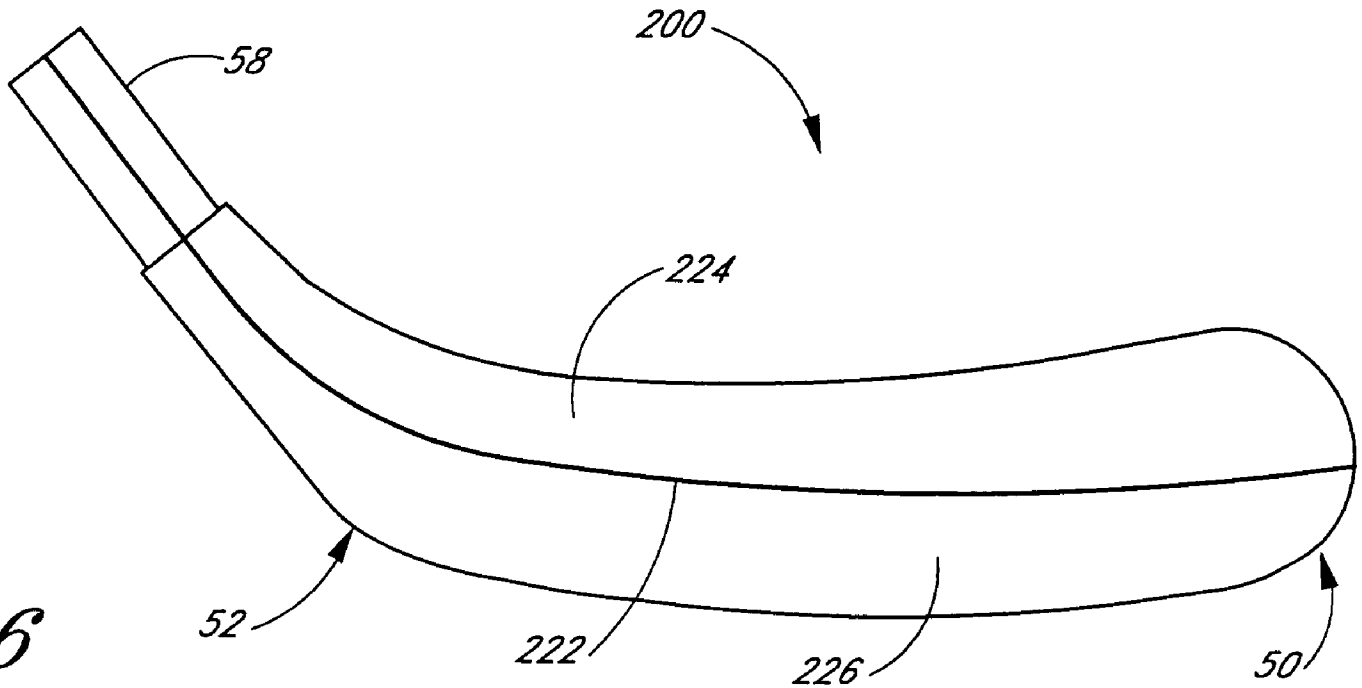
FIG. 16 is a schematic view depicting yet another embodiment of a hockey stick blade core comprising a plurality of materials having different properties.

With reference next to FIG. 16, yet another embodiment of a hockey stick blade 220 is presented. In the illustrated embodiment, the blade comprises a spine 222 between an upper core 224 and a lower core 226. Due to the size of the puck, most extreme shots involve the lower portion of the blade 220. Thus, in the illustrated embodiment the lower foam core 226 is constructed of a structurally stronger material than the upper core 224, which comprises a lighter material than that of the lower core 226. In another embodiment, only the lower core 226 comprises a cell structure.

Figure 17B:
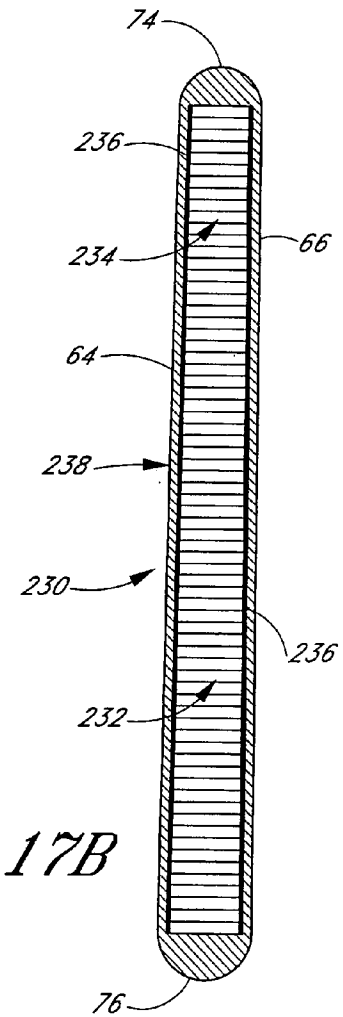
FIG. 17*b* shows a cross-sectional view of the blade of FIG. 17*a* taken along line 17*b*-17*b*.
Figure 17C:
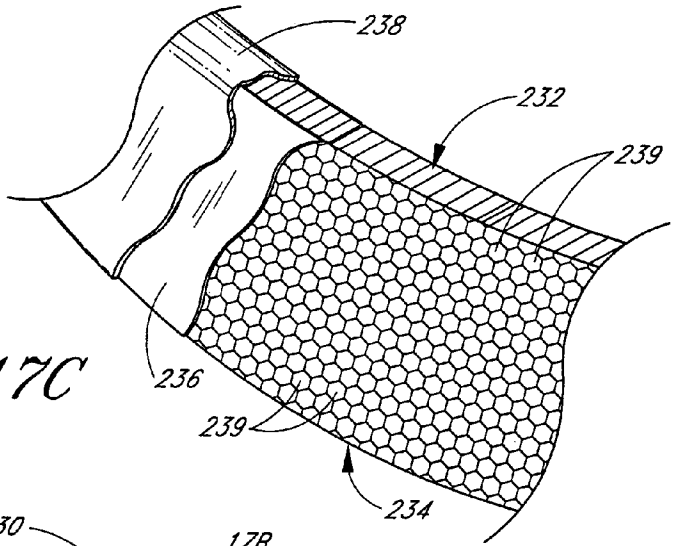
FIG. 17*c* is a partial cutaway view of the blade of FIG. 17*a*, showing the layers of the blade.
Figure 17A:
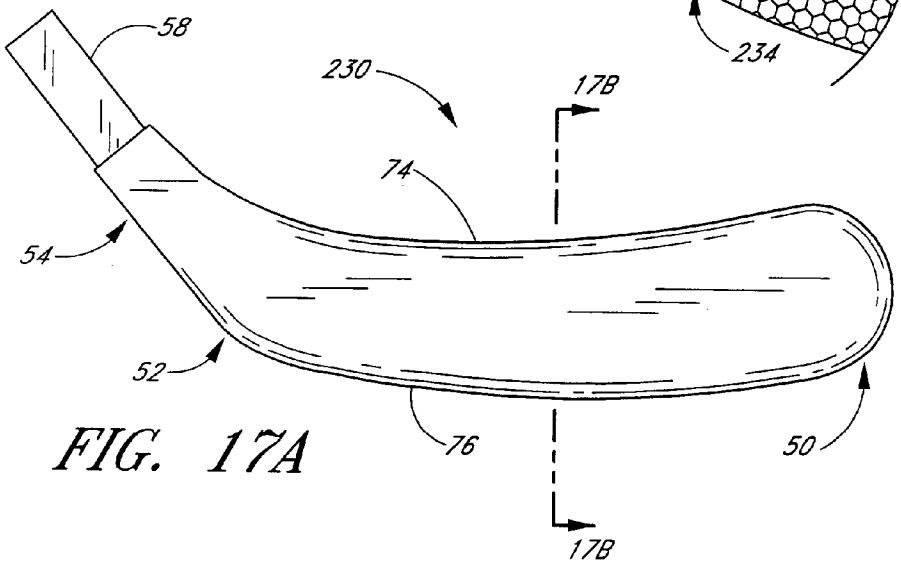
FIG. 17*a* shows another embodiment of a hockey stick blade having a core comprising a cell structure.

With reference next to FIG. 17, in yet another embodiment a hockey stick blade 230 comprises a core 232 formed of a hollow cell structure 234 that is not or only partially filled with foam. In the illustrated embodiment, the cell structure 234 comprises a honeycomb structure. Most preferably, once the cell structure 234 is shaped as desired for the core 232, flexible or rigid caps 236 are applied to enclose both ends of the cell structure 234. The core 232 is then enclosed within an outer layer 238 such as a composite laminate. Since the ends of the cell structure 234 are capped, resins and the like do not leak into or fill the hollow cells 239 during curing. Further, in other embodiments, a core having a hollow cell structure enclosed by caps can be inserted into a mold and a plastic outer casing of the blade can be injection-molded around the hollow cell structure core. Because of the caps 236, molten plastic will not penetrate into the cell structure. In another embodiment, the cell structure 234 is only partially filled with foam. For example, in one embodiment only a portion of the cell structure adjacent the front of the blade comprises foam.

Figures 18A, 18B:
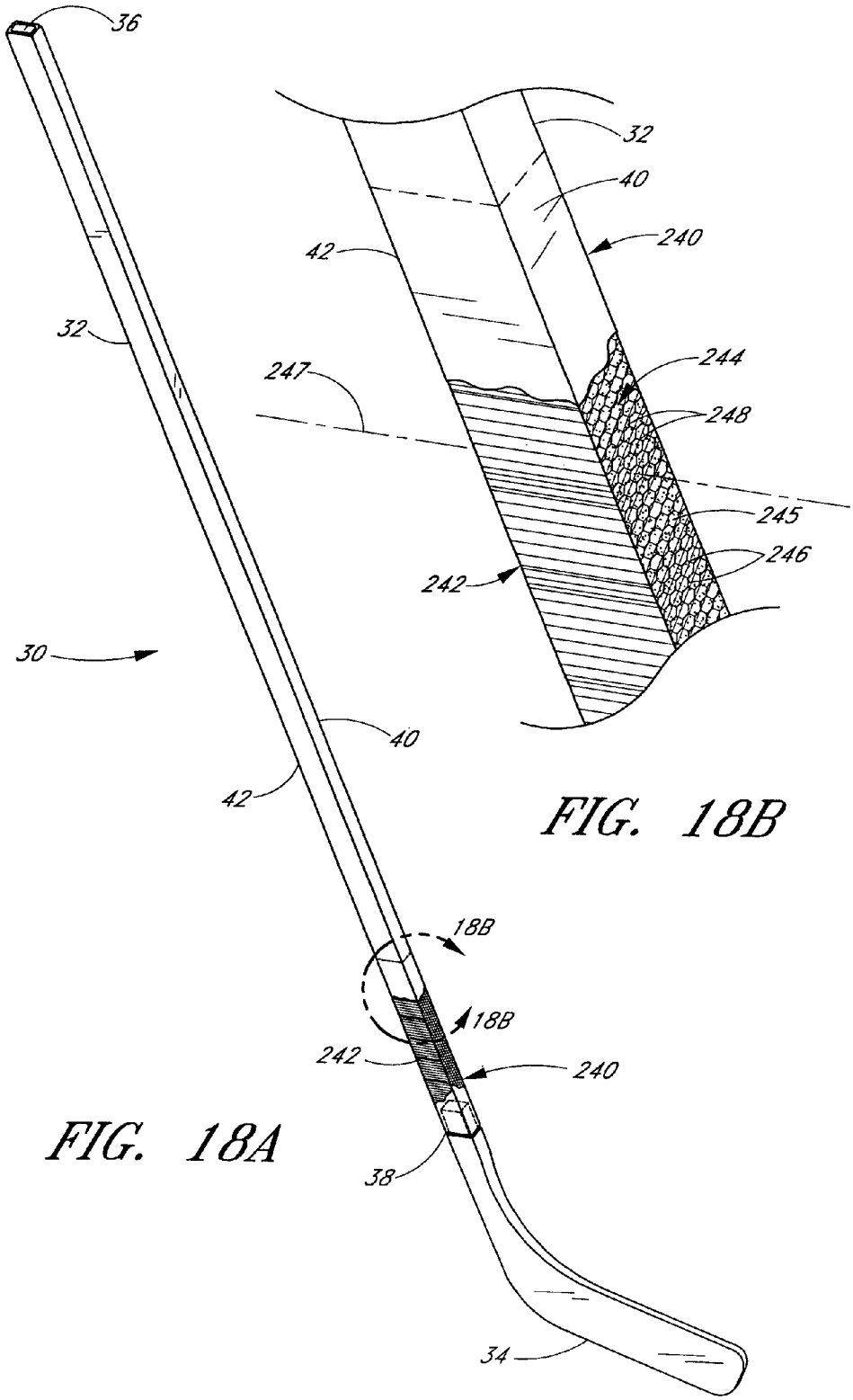
FIG. 18*a* is a partially cutaway perspective view of a hockey stick having a cell structure disposed within a portion of the handle.
FIG. 18*b* is an enlarged view of the hockey stick of FIG. 18*a* taken along line 18*b*-18*b*.

With reference next to FIG. 18, a slash zone 240 of the hockey stick shaft 32 is defined along the upper wall 40 of the shaft 32 beginning about 1 to 2 inches up the shaft from the heel end 38 of the shaft where the shaft joins to the blade 34. Preferably, the slash zone extends for about 10 to 20 inches along the shaft 32. During the game of hockey, a hockey player will commonly slash with his stick at the hockey stick of an opposing player in order to disrupt the opposing player's control of the puck. Similarly, a player in control of the puck will commonly use his hockey stick as a barrier to prevent an opposing player from contacting or otherwise accessing the puck. The area of the hockey stick that tends to be the most impacted by this slashing activity between opposing players is the slash zone 240 just discussed. Because of this slashing activity, the slash zone 240 is the site of repeated impacts between sticks. Thus, the slash zone tends to become damaged and weakened and may prematurely break even when the rest of stick is in comparably good condition.

In the embodiment illustrated in FIG. 18, a slash zone impact reinforcement insert 242 is disposed within the hollow hockey stick shaft 32 and positioned in the slash zone 240. In the illustrated embodiment, the impact support core 242 comprises a foam-filled cell structure 244 in which the cell walls 246 have a wall direction extending generally from the upper wall 40 of the stick to the lower wall 42 of the stick. The cell walls 246 are configured to generally abut at least the laminate layers of the upper wall 40 of the shaft 32. Preferably an axis 247 of the cell walls 246 extends substantially from the upper wall laminated layers 40 to the lower wall laminate layers 42.

In the illustrated configuration, the cell walls 246 help to communicate impact forces from the upper wall through the cells 248 and to the lower wall 42 so that such forces are better distributed through the shaft 32. Damage to the upper wall laminate 40 is thus reduced. Further, the foam 245 is contained by the cell structure 244 and is thus better able to resist crushing, and propagation of foam crushing is contained by the cell walls 246. As such, the core 242 makes the upper wall laminate layer more durable, resulting in increased durability for the hockey stick in the slash zone 240.

In the illustrated embodiments, a hockey stick 30 having a separately formed blade 34 and shaft 32 has been depicted. It is to be understood, however, that various configurations and types of hockey sticks can employ the principles discussed herein. For example, a hockey stick formed as single piece or as several different pieces can employ the principles discussed herein.

For the most part, the embodiments discussed above have employed a blade or shaft structure constructed of a fibrous composite. It is to be understood that other types of materials and construction methods can employ the principles discussed herein. For example, a hockey stick blade having a lightweight core may have an outer layer formed of a wood laminate, injection molded plastic or any combination of materials discussed herein or foreseeable in light of this discussion. Further, it is to be understood that the outer layer can include inserts such as metals or wood inserts molded, glued or co-formed therewith.

The embodiments discussed herein have employed a hockey stick to illustrate aspects of the invention. It is to be understood that other sporting implements having a contact portion and a handle portion may benefit from aspects disclosed herein. For example, field hockey and hurling employ implements that may use aspects discussed herein.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A method for making a sporting implement blade portion configured to withstand repeated impacts, comprising:

providing a core comprising a foam-filled cell structure, the cell structure comprising a plurality of spaced apart cell walls that cooperate to define a plurality of cells therebetween, the cell walls arranged so that each cell has a longitudinal axis, the foam being disposed in the cells;

enclosing the core in a generally rigid outer layer comprising at least one composite layer of fibers entrained in a cured resin, the outer layer having an impact surface; and treating the foam so that it preferentially expands in a desired direction prior to enclosing the core within the outer layer;

wherein the cell structure is arranged relative to the outer layer such that the longitudinal axis is generally transverse to the impact surface.

2. The method of claim 1, wherein the core is arranged so that the foam preferentially expands in a direction generally away from the impact surface.

3. The method of claim 2, wherein treating the foam comprises roughening a surface of the foam.

4. The method of claim 1, wherein the cell walls are made of a material that is more compliant than the outer layer.

5. A method for making a sporting implement blade portion configured to withstand repeated impacts, comprising:

providing a core comprising a foam-filled cell structure, the cell structure comprising a plurality of spaced apart cell walls that cooperate to define a plurality of cells therebetween, the cell walls arranged so that each cell has a longitudinal axis, the foam being disposed in the cells; and enclosing the core in a generally rigid outer layer comprising at least one composite layer of fibers entrained in a cured resin, the outer layer having an impact surface;

wherein the cell structure is arranged relative to the outer layer such that the longitudinal axis is generally transverse to the impact surface, and wherein the cell walls are made of a material that is more compliant than the outer layer and less compliant than the foam.

6. The method of claim 5, wherein providing the core comprises providing a sheet stock of a foam-filled cell structure and cutting it to a desired size.

7. The method of claim 5, wherein providing the core comprises providing a cell structure shaped to generally approximate a shape of the core, placing the shaped cell structure in a mold that approximates the shape of the core, and injecting an expanding structural foam into the mold.

8. The method of claim 5 additionally comprising providing a second core, arranging the second core adjacent the first core, and enclosing both the first and second cores in a generally rigid outer layer so that a generally rigid spine is disposed between the first and second cores.

9. The method of claim 8, wherein the second core is made of a different material than the first core.

10. The method of claim 9, wherein the second core comprises a foam-filled cell structure.

11. The method of claim 5, wherein the cell walls are made of a material having greater ability to dampen vibrations from impacts than does the composite layer.

12. The method of claim 5, wherein a diameter of the cells is between about ⅛ in. and ⅜ in.

13. The method of claim 5, wherein the core comprises a first zone and a second zone, each zone comprising the cell structure and foam in a corresponding area of the core, and the first zone of the core has different structural properties than does the second zone.

14. The method of claim 5 additionally comprising providing a handle portion, and joining the blade portion to the handle portion, wherein the blade portion comprises a tenon adapted to connect to the handle portion, and in the tenon of the blade portion, the core comprises an expanded foam but does not include cell walls.

15. The method of claim 5 additionally comprising placing an insert in the impact surface of the outer layer, the insert constructed of a different material than the rest of the outer layer.

16. The method of claim 15, wherein the insert comprises a metal.

17. The method of claim 5 additionally comprising treating the foam so that it preferentially expands in a desired direction prior to enclosing the core within the outer layer.

18. The method of claim 17, wherein the core is arranged so that the foam preferentially expands in a direction generally away from the impact surface.

19. The method of claim 18, wherein treating the foam comprises roughening a surface of the foam.

20. The method of claim 5, wherein the cell structure is arranged so that at least some of the cell walls are substantially in contact with the outer layer.

21. A method for making a sporting implement having a handle portion and a blade portion configured to withstand repeated impacts, comprising:

providing a blade core comprising a foam-filled cell structure, the cell structure comprising a plurality of spaced apart cell walls that cooperate to define a plurality of cells therebetween, the cell walls arranged so that each cell has a longitudinal axis, the foam being disposed in the cells;

enclosing the blade core in a generally rigid outer layer comprising at least one composite layer of fibers entrained in a cured resin, the outer layer having an impact surface;

providing a handle portion; and joining the blade portion to the handle portions;

wherein the blade portion comprises a tenon adapted to connect to the handle portion, and in the tenon of the blade portion, the core comprises an expanded foam but does not include cell walls;

wherein the cell structure is arranged relative to the outer layer such that the longitudinal axis is generally transverse to the impact surface.

22. A sports stick having a handle portion and a contact portion, the contact portion configured to impact a sports implement and having a cover comprising a primary impact face and a secondary impact face that generally oppose one another, the cover comprising at least one composite layer of fibers entrained in a cured resin, and a generally rigid elongate spine extends between the primary and secondary impact faces along the length of the contact portion, the contact portion further comprising an upper core and a lower core substantially surrounded by the cover, the upper and lower cores being separated from one another by the elongate spine, at least one of the cores comprising a celled structural member constructed of a different material than the cover and comprising a plurality of cell walls, the cell walls arranged to extend generally in a direction from the primary impact face to the secondary impact face, wherein the cell walls are constructed of a first material and the primary impact face is constructed of a second material, the first material being more compliant than the second material, wherein the cell walls are more compliant than the primary impact face, the celled structural member comprising an expanded foam disposed between the cell walls, wherein the foam is more compliant than the cell walls.

23. The sports stick of claim 22, wherein the celled member is configured to absorb and dampen vibrations from impacts to the primary impact face.

24. The sports stick of claim 22, wherein the spine comprises a composite made up of fibers entrained in a cured resin.

25. The sports stick of claim 22, wherein the upper core has different structural properties than the lower core.

26. The sports stick of claim 25, wherein both the upper core and the lower core comprise a celled structural member comprising an expanded foam disposed between the cell walls.

27. The sports stick of claim 22, wherein the primary impact face comprises an insert attached thereto, the insert constructed of a different material than the rest of the impact face.

28. The sports stick of claim 27, wherein the insert comprises a metal.

29. The sports stick of claim 22, wherein the contact portion is elongate and has a heel end and a toe end, and the spine extends from the heel end to toe end.

30. A sports stick having a handle portion and a contact portion, the contact portion configured to impact a sports implement and having a cover comprising a primary impact face and a secondary impact face that generally oppose one another, the cover comprising at least one composite layer of fibers entrained in a cured resin, the primary impact face comprising an insert attached thereto, the insert constructed of a different material than the rest of the primary impact face, the insert comprising a metal, and a generally rigid elongate spine extends between the primary and secondary impact faces along the length of the contact portion, the contact portion further comprising an upper core and a lower core substantially surrounded by the cover, the upper and lower cores being separated from one another by the elongate spine, at least one of the cores comprising a celled structural member constructed of a different material than the cover and comprising a plurality of cell walls, the cell walls arranged to extend generally in a direction from the primary impact face to the secondary impact face.

* * * * *

UNITED STATES PATENT AND TRADEMARK OFFICE

CERTIFICATE OF CORRECTION

PATENT NO. : 7,329,195 B2
APPLICATION NO. : 11/357241
DATED : February 12, 2008
INVENTOR(S) : Robert T. Pearson It is certified that error appears in the above-identified patent and that said Letters Patent is hereby corrected as shown below:

At Column 1, line 18, before "The" insert -- Description of --.

At Column 2, line 48, delete "embodiment," and insert -- embodiments, -- therefor.

At Column 3, line 22, delete "stick blade" and insert -- more --, therefor.

At Column 10, line 34, delete "laminated" and insert -- laminate --, therefor.

At Column 13, line 1, in Claim 21, after "handle" delete "portions;" and insert -- portion; --, therefor.

Signed and Sealed this

Thirtieth Day of September, 2008

JON W. DUDAS
*Director of the United States Patent and Trademark Office*